United States Patent [19]

Lenart

[11] Patent Number: 4,631,645

[45] Date of Patent: Dec. 23, 1986

[54] HEADLAMP ASSEMBLY

[76] Inventor: Stanley Lenart, Rte. 12, Alder Creek, N.Y. 13301

[21] Appl. No.: 747,796

[22] Filed: Jun. 24, 1985

[51] Int. Cl.[4] ..... F21L 15/14

[52] U.S. Cl. ..... 362/105; 362/275

[58] Field of Search ..... 362/105, 106, 103, 107, 362/426, 427, 275; 128/380, 201.27, 201.24; 2/209.2; D26/39

[56] References Cited

U.S. PATENT DOCUMENTS

| | | | |
|---|---|---|---|
| 1,201,350 | 10/1916 | Royce | 362/105 |
| 1,217,666 | 2/1917 | Thulin | 362/103 |
| 1,305,852 | 6/1919 | Widmer | 362/105 |
| 1,584,276 | 5/1926 | Coulter | 362/105 |
| 2,165,531 | 7/1939 | Bertrand | 362/275 |
| 3,149,785 | 9/1964 | Appleton | 362/275 |
| 3,309,691 | 4/1967 | Bonanno | 362/106 |
| 3,830,230 | 8/1974 | Chester | 362/105 |

FOREIGN PATENT DOCUMENTS

| | | | |
|---|---|---|---|
| 2305684 | 10/1976 | France | 362/105 |

*Primary Examiner*—William A. Cuchlinski, Jr.
*Assistant Examiner*—D. M. Cox
*Attorney, Agent, or Firm*—Bruns and Wall

[57] ABSTRACT

A headlamp assembly that is particularly adapted for use by auto mechanics, and has as its principal components an adjustable headband to which two overhead straps are secured and a lamp that is slidably mounted on one of the straps. The lamp is pivotally connected by a double pivot mechanism to a slide member that can be positioned at any point along said one overhead strap. In the selected position, the lamp can be moved into a wide range of different angular positions.

9 Claims, 3 Drawing Figures

HEADLAMP ASSEMBLY

BACKGROUND OF THE INVENTION

This invention relates generally to head supported illumination devices, and has special reference to a novel headlamp assembly that is particularly well adapted for use by automobile mechanics.

A substantial number of head supported illumination devices have been developed heretofore for surgeons and physicians, miners, mechanics and others. Most of these include a head encircling band and a lamp that is attached at some point to the band. In some of the devices the lamp is capable of angular adjustment.

For an automobile mechanic who may have to work in a lying down position beneath a vehicle, a headlamp can be very helpful particularly if the angular position of the lamp can be readily adjusted. The only prior art patents known to the applicant that are specifically directed to headlamps for mechanics are U.S. Pat. Nos. 2,268,156 to Maddox and 2,421 643 to Ostli. The Maddox device provides a head support for a plurality of light bulbs but the position of these bulbs is not adjustable. The Ostli device discloses a helmet to which a flashlight can be releasably connected, the flashlight being angularly adjustable in one plane only.

Additional prior art patents, developed in the course of a preliminary search, are U.S. Pat. Nos. 2,585,592; 2,765,398; 3,249,271; 3,250,909; 3,634,676; 4,234,910; 4,400,763 and 4,462,064.

SUMMARY OF THE PRESENT INVENTION

The headlamp assembly of the present invention is particularly well adapted for use by auto mechanics, and has as its principal components an adjustable headband to which two overhead straps are secured and a lamp that is slidably mounted on one of the straps. The lamp is pivotally connected by a double pivot mechanism to a slide member that can be positioned at any point along said one overhead strap. In the selected position, the lamp can be moved into a wide range of different angular positions.

The headlamp assembly also includes an adjustable chin strap that ensures that the headlamp assembly will remain in position on the mechanic's head even when he is working in a lying down position. Power for the lamp is supplied by a suitable battery that can be mounted on the headlamp assembly or worn elsewhere on the person of the user.

DESCRIPTION OF THE PREFERRED EMBODIMENT

Figure 1:
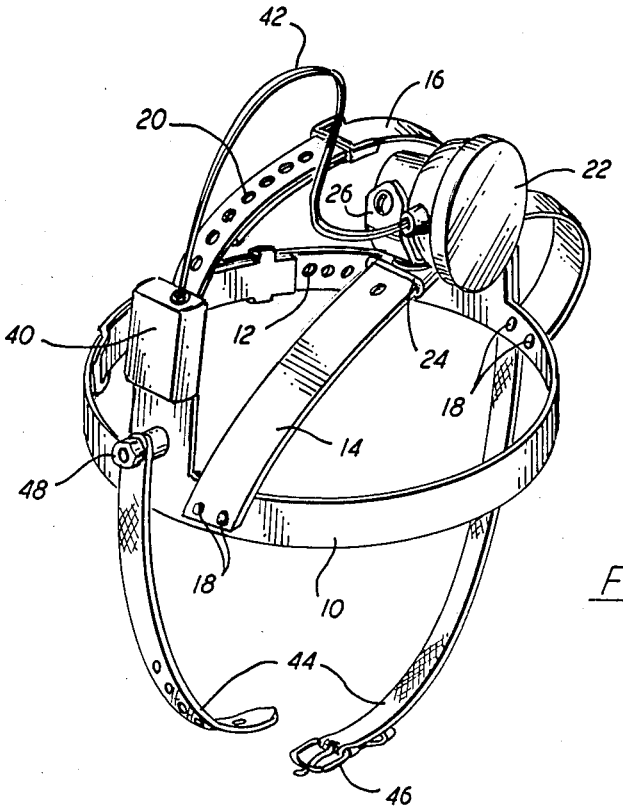
FIG. 1 is a perspective view of a headlamp assembly embodying the invention.

Having reference now to the drawings, the headlamp assembly of the invention includes a head encircling headband 10 having size adjustment means 12 of conventional design. A pair of overhead straps 14 and 16 are connected to the headband 10, and the forward strap 14 is a one piece, unitary member the opposite ends of which are secured to the headband as by rivets

18. The overhead strap 16 consists of two pieces connected together by adjustment means 20 and having its outer ends suitably secured to the headband.

The rearward strap 16 extends substantially vertically over the head of the wearer when the headlamp is being worn while the forward strap 14 is disposed at an oblique angle to strap 16 so that it is inclined forwardly toward the forehead of the wearer. The headband 10 and straps 14 and 16 are preferably made of flexible plastic material although it will be apparent that other materials such as canvas can also be used.

The forward strap 14 carries a lamp 22 that is slidably mounted on the strap by means of a mounting member in the form of a slide 24. With this arrangement, the lamp can be positioned at any point along the strap 14 as indicated by the phantom line illustrations in FIG. 2. To facilitate movement of the slide 24 along strap 14, the strap 16 can be adjusted so that there is clearance between strap 14 and the head of the wearer.

Figure 3:
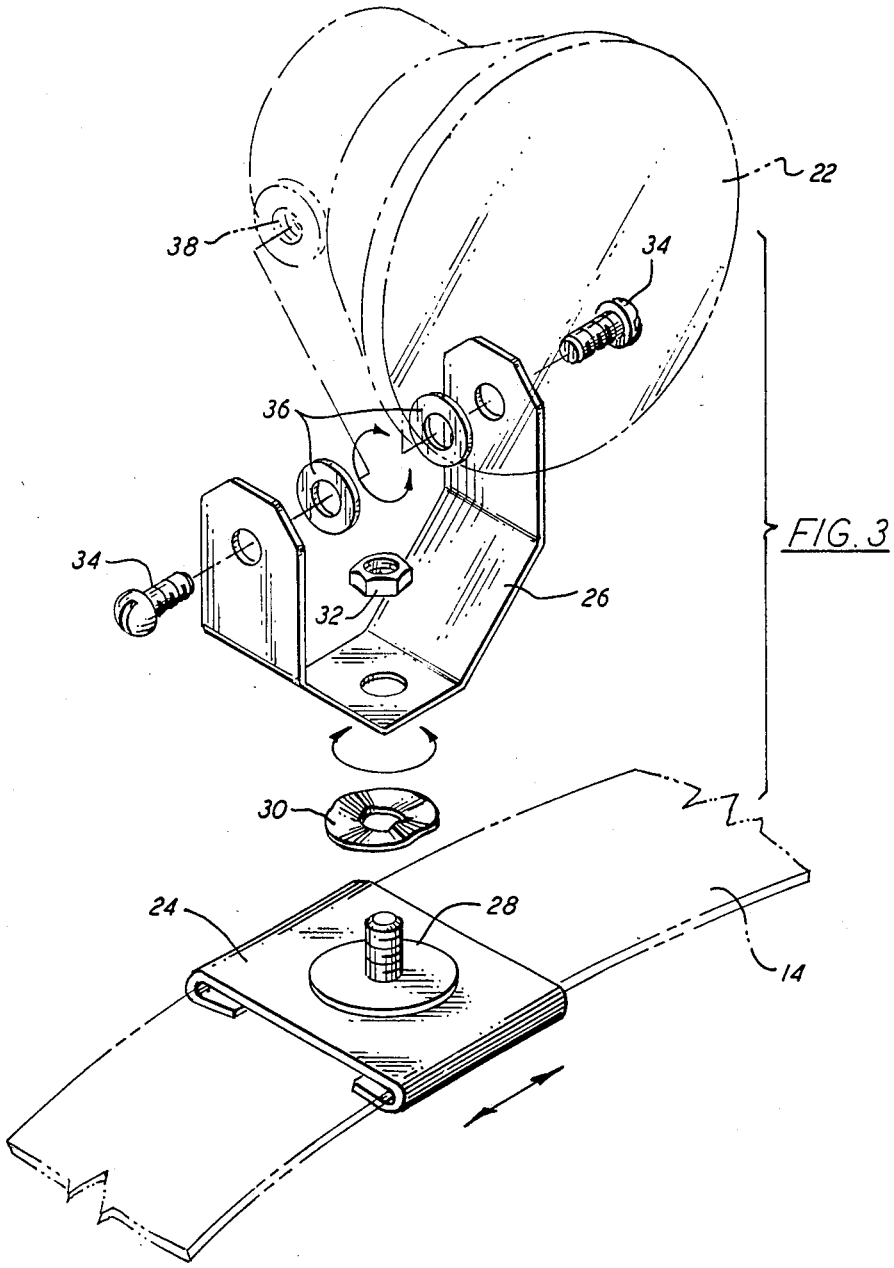
FIG. 3 is an exploded view of the lamp mounting means.

The lamp 22 is pivotally connected to the slide 24 by means of a yoke-like connecting bracket 26 as best shown in FIG. 3. The bottom of this bracket is connected to the slide through a threaded stud 28, washer 30 and nut 32 whereby the bracket can be pivoted about a substantially vertical axis as viewed in FIG. 3. The side arms of bracket 26 are connected to the lamp housing through screws 34 and washers 36, the screws being received in threaded bores 38 in the housing. The lamp can thus be pivoted about a horizontal as well as a vertical axis which permits it to be moved into a wide range of different angular positions.

Figure 2:
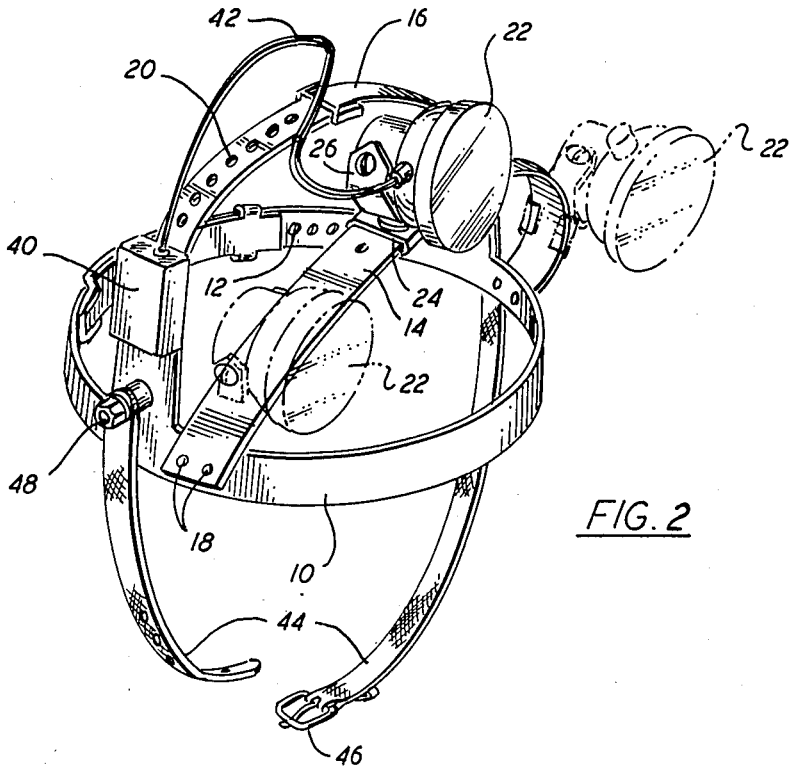
FIG. 2 is a view corresponding to FIG. 1 showing in phantom lines how the lamp can be located in different positions along its supporting overhead strap.

The power source for the lamp 22 is a battery 40, FIGS. 1 and 2, of either the rechargeable or non-rechargeable type. As shown in the drawings, this battery can be mounted on the overhead strap 16 and connected to the lamp by a cord 42. Alternatively, the battery can be carried in a pocket or connected to the user's belt.

The headlamp assembly is provided with a two-piece chin strap 44, the two parts of which are adjustably connected together as by a buckle 46 or "Velcro" fastener (not shown). The outer ends of the chin strap are connected to the headband by a pivot connection one of which is shown at 48. The chin strap 44 ensures that the headlamp assembly will remain in position on the mechanic's head even when he is working in a lying down position.

The slide and dual pivot arrangement for the lamp 22 permits the lamp to be moved into almost any position that might be required by the mechanic or other user whether he be working in a lying down, bending over or standing position. As will be apparent from the foregoing description, the invention provides an advantageous improvement in headlamp assemblies. As will be understood by those familiar with the art, the invention may be embodied in other specific forms without departing from the spirit or essential characteristics thereof.

I claim:

1. A headlamp assembly comprising in combination an adjustable head encircling headband, an overhead strap connected at its opposite ends to the headband, a yoke positioned on the overhead strap for sliding movement therealong between its opposite ends, and a lamp, and said yoke including means pivotally connecting the lamp to the mounting member whereby the lamp can be located at any point along the overhead strap and can be disposed in a position of desired angular adjustment, said yoke being pivotal on one axis normal to said strap and said lamp being pivotal on said yoke at another axis at right angles to said one axis.

2. A headlamp asembly as defined in claim 1 together with an adjustable chin strap the ends of which are connected to the headband.

3. A headlamp assembly as defined in claim 1 together with a power source for the lamp mounted on the assembly.

4. A headlight assembly as defined in claim 1 wherein said yoke includes a bracket having a pair of side arms pivotally connected to opposite sides of said lamp to define said other axis.

5. A headlight assembly as defined in claim 1 wherein said yoke includes separate first and second pivot means respectively defining said one axis and defining said other axis.

6. A headlamp assembly particularly for mechanics comprising in combination an adjustable head encircling headband; a first, unitary overhead strap connected at its opposite ends to the headband; a second, adjustable overhead strap connected at its opposite ends to the headband; the first and second overhead straps being disposed at an oblique angle to one another; a mounting member positioned on the first overhead strap for sliding movement therealong between its opposite ends; a lamp; means pivotally connecting the lamp to the mounting member whereby the lamp can be located at any point along the overhead strap and disposed in a position of desired angular adjustment; and an adjustable chin strap the ends of which are connected to the headband.

7. A headlamp assembly as defined in claim 6 wherein the means pivotally connecting the lamp to the mounting member includes dual pivot axes.

8. A headlamp assembly as defined in claim 6 together with a power source for the lamp mounted on the assembly.

9. A headlamp assembly as defined in claim 6 wherein the second overhead strap extends substantially vertically over the head of the wearer when the headlamp assembly is worn, the first overhead strap being disposed at an oblique angle to the second strap whereby it is inclined forwardly toward the forehead of the wearer.

* * * * *